US009228814B2

(12) United States Patent
Macy et al.

(10) Patent No.: US 9,228,814 B2
(45) Date of Patent: Jan. 5, 2016

(54) DELIVERY SHELL USING GYROSCOPIC GUIDING SYSTEM AND METHODS OF MAKING THE SAME

(75) Inventors: Omar Alonso Macy, San Jose, CA (US); Loc T. Pham, San Jose, CA (US)

(73) Assignee: Real Achon Paintball, Inc. (RAP4), Gilroy, CA (US)

( * ) Notice: Subject to any disclaimer, the term of this patent is extended or adjusted under 35 U.S.C. 154(b) by 197 days.

(21) Appl. No.: 13/524,906

(22) Filed: Jun. 15, 2012

(65) Prior Publication Data

US 2013/0337949 A1 Dec. 19, 2013

(51) Int. Cl.

| | |
|---|---|
| ***F42B 10/16*** | (2006.01) |
| ***F42B 12/40*** | (2006.01) |
| ***F42B 10/06*** | (2006.01) |
| ***F42B 8/16*** | (2006.01) |
| ***F41A 9/65*** | (2006.01) |
| ***F41B 11/55*** | (2013.01) |

(52) U.S. Cl.

CPC . *F42B 10/16* (2013.01); *F41A 9/65* (2013.01); *F41B 11/55* (2013.01); *F42B 8/16* (2013.01); *F42B 10/06* (2013.01); *F42B 12/40* (2013.01)

(58) Field of Classification Search

CPC ..... F42B 10/00; F42B 10/02; F42B 10/04; F42B 10/06; F42B 10/16; F42B 10/26; F42B 8/16; F42B 12/40

USPC ..... 102/501, 502, 512, 513

See application file for complete search history.

(56) References Cited

U.S. PATENT DOCUMENTS

| | | | | |
|---|---|---|---|---|
| 34,596 | A * | 3/1862 | Small | 102/524 |
| 1,920,257 | A * | 8/1933 | Halland | F42B 12/40 102/395 |
| 2,338,719 | A * | 1/1944 | Holt | F42B 12/40 102/395 |
| 3,190,654 | A * | 6/1965 | Ross | 273/378 |
| 3,611,930 | A * | 10/1971 | Kensinger | 102/386 |
| 5,009,164 | A * | 4/1991 | Grinberg | 102/502 |
| D348,907 | S * | 7/1994 | Prentice et al. | D21/454 |
| 5,361,700 | A * | 11/1994 | Carbone | 102/439 |
| 5,936,190 | A * | 8/1999 | Buzick | 102/502 |
| 6,230,630 | B1 | 5/2001 | Gibson | |
| 6,615,739 | B2 * | 9/2003 | Gibson et al. | 102/513 |
| 6,764,042 | B2 * | 7/2004 | Moore et al. | 244/3.28 |
| 7,228,802 | B2 * | 6/2007 | Montefusco | F42B 8/16 102/501 |
| 7,526,998 | B2 * | 5/2009 | Vasel et al. | 102/502 |
| 7,631,601 | B2 * | 12/2009 | Feldman et al. | 102/502 |
| D656,997 | S * | 4/2012 | Levin et al. | D21/404 |
| 8,875,634 | B2 * | 11/2014 | Gibson | F42B 10/06 102/502 |
| 2006/0283431 | A1 * | 12/2006 | Lee et al. | 124/41.1 |
| 2009/0013892 | A1 * | 1/2009 | Judson et al. | 102/502 |
| 2012/0199034 | A1 * | 8/2012 | Gibson et al. | 102/502 |

* cited by examiner

*Primary Examiner* — James S Bergin

(74) *Attorney, Agent, or Firm* — James M. Wu; JW Law Group

(57) ABSTRACT

A projectile such as a paintball including a ball-shaped capsule and a round-shaped disc capable of facilitating accuracy of projectile travel direction is disclosed. The ball-shaped or substantial ball-shaped capsule, in one embodiment, having a head and a tail is able to store and deliver colored markers upon an impact between the projectile and an object. The round-shaped disc is positioned at a place so that allowing a portion of the round-shaped disc to extend above outer surface of the capsule. The disc is able to catch at least airflow when the projectile is launched. The round-shaped disc, in one example, uses the direction of the airflow to facilitate travel direction of the projectile.

14 Claims, 20 Drawing Sheets

DELIVERY SHELL USING GYROSCOPIC GUIDING SYSTEM AND METHODS OF MAKING THE SAME

FIELD

The present invention relates to projectiles carrying payloads capable of being propelled by launch systems or apparatus. More specifically, the present invention relates to ammunition capable of being launched by compressed gas guns.

BACKGROUND

With increasing applicability of projectile ammunitions launched by gas-powered guns, projectiles with enhanced accuracy and distance are in high demand. For example, gas-powered guns such as paintball guns loaded with various types of paintballs are often used in many different settings and environments, such as paintball tournaments, police and military trainings, special effects on movie shootings, riot controls, et cetera. A conventional gas-powered gun such as a paintball gun uses carbon dioxide ($CO_2$) or compressed air to propel ammunition such as a delivery shell or paintball from its chamber to a target or object via its barrel.

A delivery shell or a paintball typically carries colored paint or marker and it breaks upon a high speed impact. To accurately reach an intended target, both the design of projectile and the power of paintball guns are important factors.

SUMMARY

A projectile such as a paintball including a ball-shaped or dome-shaped capsule and a round-shaped disc for improving accuracy and range of the projectile using gyroscopic approach is disclosed. The ball-shaped capsule, in one embodiment, having a head and a tail portion is able to store and deliver colored marker upon an impact between the projectile and an object. The round-shaped disc is positioned at a location to allow a portion of the round-shaped disc to extend above outer surface of the capsule. The disc is able to catch at least a portion of airflow when the projectile travels through the air after launching. The round-shaped disc, in one example, leverages airflows to facilitate and/or maintain travel direction of the projectile.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
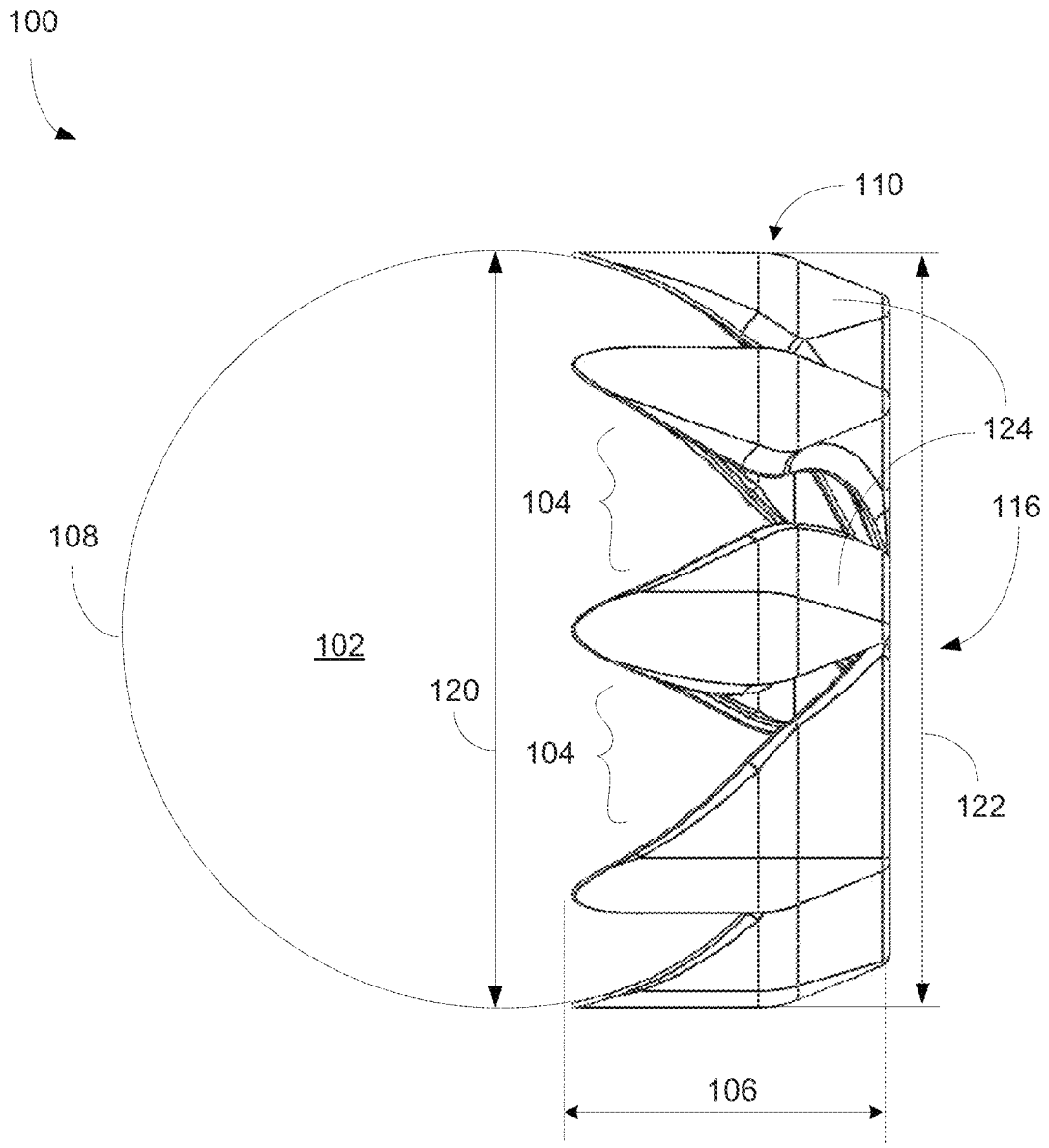
FIGS. 1A-B are diagrams showing a delivery shell or projectile having a capsule and a disc in accordance with one embodiment of the present invention.

Exemplary embodiment(s) of the present invention is described herein in the context of a method, system and apparatus of providing a delivery shell having a dome-shaped head portion and a disc capable of being launched by a gas-powered propelling system.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

A delivery shell such as a projectile or a paintball including a ball-shaped capsule and a round-shaped disc for facilitating accuracy of projectile travel direction is disclosed. The ball-shaped or substantial ball-shaped capsule, in one embodiment, having a head and a tail is able to store and deliver colored markers upon an impact between the projectile and an object. The round-shaped disc is positioned at a place to allow a portion of the round-shaped disc to extend above outer surface of the capsule. The disc is able to catch airflow when the shell is launched. The round-shaped disc, in one example, uses airflows to facilitate travel direction of the projectile.

FIG. 1A illustrates a delivery shell 100 having a ball-shaped capsule and a round-shaped disc in accordance with one embodiment of the present invention. Shell 100 can also be referred to as a paintball, projectile, aerodynamic projectile, ammunition, and the like. Shell 100, in one embodiment, includes a ball-shaped capsule 102 and a round-shaped disc 110, wherein disc 110 is configured in such a way that it is able to couple to capsule 102 almost seamlessly. Note that capsule 102 and disc 110 can be fabricated together onto a single unit. It should be noted that the underlying concept of the exemplary embodiment(s) of the present invention would not change if one or more components (or elements) were added to or removed from shell 100.

Capsule 102 has a head 108 and a tail 116 and has an approximately spherical or ball-shaped body. Depending on the applications, diameter 120 of capsule 102 should have a range of 0.40 to 0.75 inch or caliber. Inside of capsule 102 is hollow and is able to store or carry user defined substances, such as, but not limited to, non-lethal color marker, non-lethal payload, lethal payload, non-lethal chemical agent, combustible material, and the like. Depending on the payload, capsule 102 can be fabricated with stretchable semi-solid material, such as plastic, polymer, rubber, polyurethane, synthetic material, or a combination of plastic, polymer, rubber, polyurethane. Alternatively, capsule 102 can also be made by different synthetic as well as natural materials, such as plant/animal wax, paraffin wax, beeswax, and/or other biodegradable substances.

Disc 110 is configured to have a generally flat circular configuration, and it has a diameter 122 and a height 106. Diameters 120 and 122, in one example, are approximately the same. In one embodiment, disc 110 includes multiple blades or aerodynamic blades 124 wherein each of blades 124 has a blade tip edge, a blade body, and a blade exit edge. The blade tip edge, the blade body, the blade exit edge, and a portion of capsule surface form an air channel 104 for facilitating spinning motion for shell 100. In one aspect, the exit edges have curved shapes, wherein portions of the exit edges are commonly joined at a flat base plane.

Shell 100, in one embodiment, is a projectile capable of being launched by a paintball gun. Sell 100 includes a ball-shaped capsule 102 and round-shaped disc 110. Capsule 102 having a head 108 and a tail 116 is able to store and deliver colored markers upon an impact with an object. Disc 110 is coupled to tail 116 of capsule 102 in such a way that it allows a portion of disc 110 to extend above outer surface of capsule 102 to catch airflow when shell 100 moves in the air. Disc 110 is able to leverage direction of airflows to facilitate or adjust travel direction of shell 100. Disc 110, in one example, includes a coupler, not shown in FIG. 1A, having a concave surface configured to receive tail 116 of capsule 102. The concave surface of the coupler contains an opening that allows a portion of tail 116 to pass through for coupling or seating.

During operation, upon impact with a targeted object, capsule 102 breaks and delivers the payload such as colored marker to an area in the vicinity of the impact. It should be noted that when shell 100 moves in the air after it is launched by a paintball gun, airflow, for instance, may pass through air channels 104 which induces spinning motion of shell 100. The lift force, for example, may create a torque causing spinning motion for shell 100 with a spinning axis coincided with the travel direction (or forward motion). Note that the spinning motion increases the stability or gyroscopic guiding motion to shell 100 whereby accuracy for shell 100 to hit a target is enhanced.

To be compatible with ammunition cartridge and launchers, diameter 122 and height 106 of disc 110 can be adjusted. For example, diameter 122 is configured to have the approximately the same size as diameter 120 of capsule 102 and height 106 may be about the radius of capsule 102. Depending on the applications, other shell dimensions may be used.

Figure 1B:
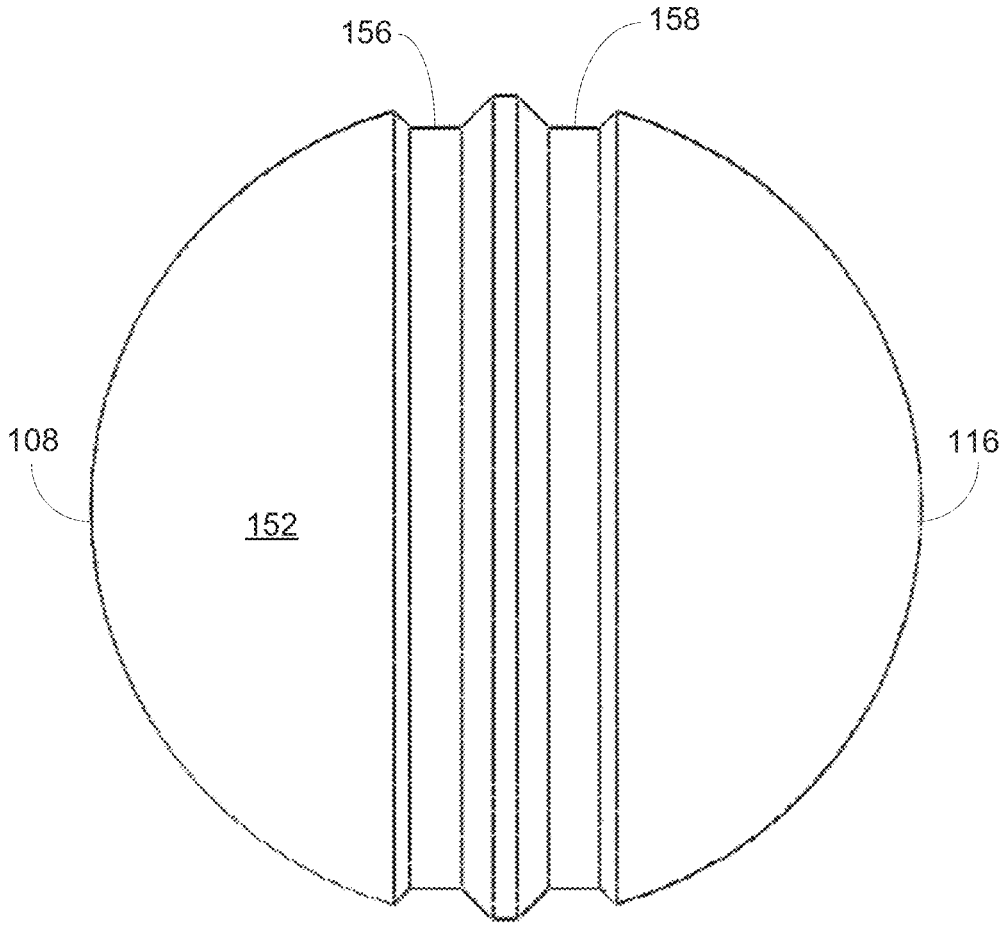

FIG. 1B is a diagram showing a delivery shell 152 having a groove for housing a driving band in accordance with one embodiment of the present invention. Shell 152 is similar to shell 100 illustrated in FIG. 1A except that shell 152 includes two grooves 156-158. In one embodiment, grooves 156-158 are configured to allow two driving bands, not shown in figure, to fit onto grooves 156-158 to enhance efficiency for gas-powered launcher as well as provide gyroscopic stability. It should be noted that the underlying concept of the exemplary embodiment(s) of the present invention would not change if shell 152 contains one groove 156 or additional grooves are added.

A driving band, not shown in FIG. 1B, is a circular strip capable of fitting into a predefined circular groove such as groove 156 of capsule 152. Capsule 152 includes a circumferential groove 156 capable of receiving a driving band wherein a portion of the driving band extends above the surface of capsule 152 to catch at least a portion of airflow which will be used to guide the travel direction of shell 152. Alternatively, when a shell with a driving band is loaded in the firing chamber, the driving band is able to seal at least a portion of space between the shell and the barrel to prevent gas leakage during the gas-powered launch.

Figure 2B:
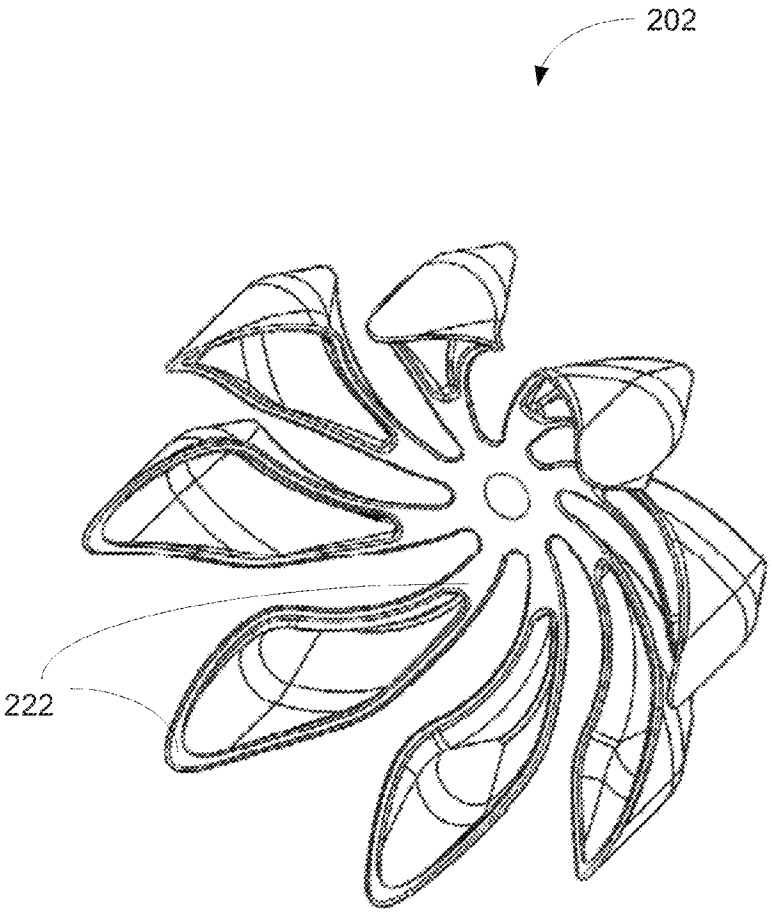
FIGS. 2A-C are three-dimensional ("3D") diagrams illustrating an exemplary disc having multiple blades in accordance with one embodiment of the invention showing.
Figure 2A:
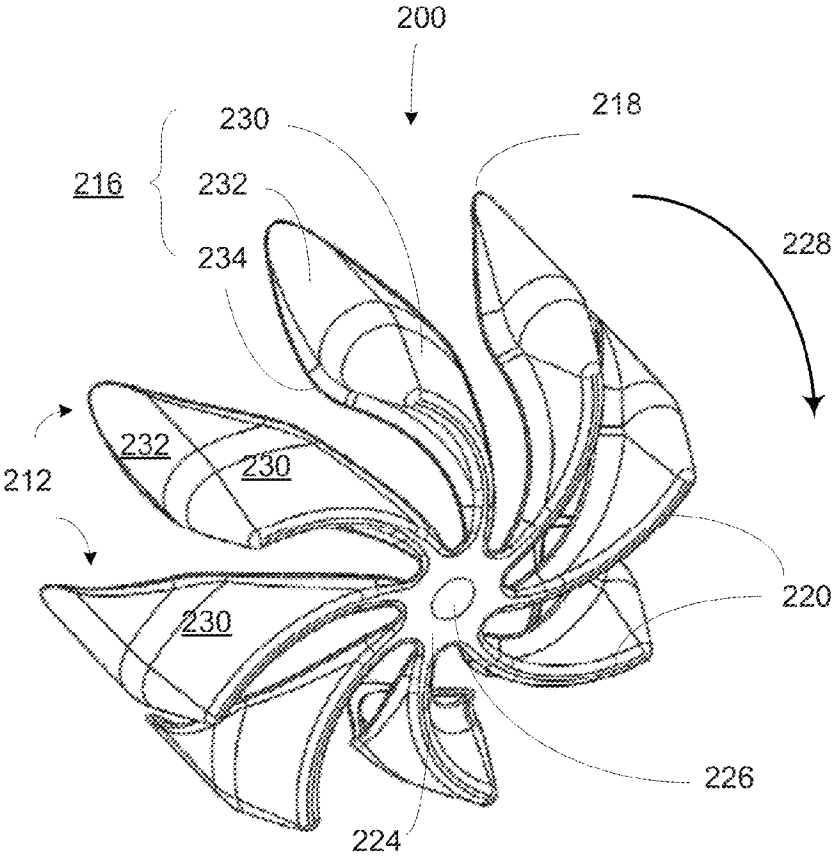
Figure 2C:
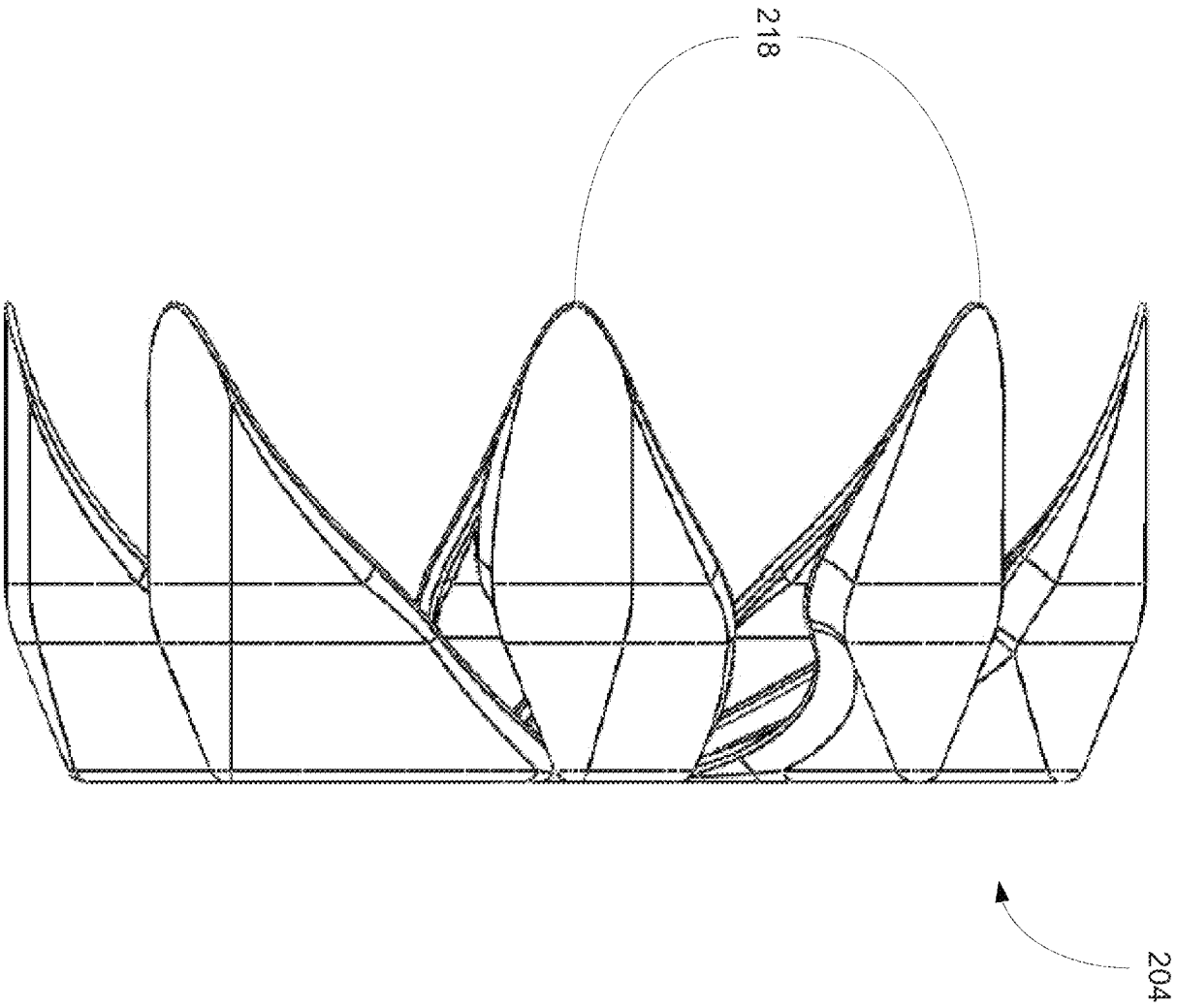

FIGS. 2A-C are three-dimensional ("3D") diagrams 200-204 illustrating an exemplary disc having multiple blades in accordance with one embodiment of the invention showing. Diagram 200 illustrates a disc viewing from a back angle showing a flat base plane 224 with an opening 226 and multiple blades 212. Eight (8) blades 212 are shown in diagram 200 wherein a side of each blade 212 is attached or joined at flat base plane 224. Diagram 200 shows airflow surface 216 associated with blades 212. Diagram 202 illustrates a disc having a view of inner surface 222 used to attach to a capsule such as capsule 102. Diagram 204 is a side view of disc showing airflow surface 216.

Disc 200 includes eight (8) blades or aerodynamic blades 212, wherein each blade has an airflow surface 216 and an inner surface 222. Airflow surface 216 includes a blade tip 218, an exit edge 220, and a blade body wherein blade body is defined by an upper surface 230, a lower surface 234, and a side surface 232. Side surface 132 joins upper surface 230 and lower surface 234 and extends to exit edge 220. Note that blade exit edge 220, blade tip 218, blade body, and a portion of capsule surface form an air channel. When airflow travels through airflow surface 216, the curvature of blade 212 allows airflow to generate spinning motion for the shell or projectile.

Note that exit edges 220 of blades 212 have curved shapes and are commonly joined to flat base plane 224. It should be noted that disc and capsule can be manufactured together as a single unit.

Each blade 212 is configured to have an aerodynamic shape for reducing air drag while redirecting airflow to generate spinning motion. Blades 212 as shown in FIG. 2A are spaced in equal distance for creating air channels between two adjacent blades 212. Upper surface 230 and lower surface 234 are converged at downstream of airflow to form exit edge 220. Airflow surface 216 uses its aerodynamic surface to generate spinning force when the air stream passes over surface 216.

Inner surface 222 is configured to seat at least a portion of capsule such as a tail end of capsule 102 shown in FIG. 1A. Note that the capsule is not limited to a spherical or ball shape capsule and it, for example, can be an elongated spherical or ellipsoid shaped capsule. It should be further noted that when the capsule is not spherical, inner surface 122 may be adjusted to the contours of capsule for coupling purposes. In one aspect, inner surface 222 is configured to have a contour closely matching with surface contour of capsule.

When a shell travels through the air, airflow surface 216 is shaped in such a way that it catches a portion of air stream. For example, when air stream passes through upper surface 230 and lower surface 234, different air pressures between the surfaces are exerted whereby a torque is induced. The torque introduces spin motion for the shell. It should be noted that blades 212 are arranged in a circular formation and they can cause the shell to spin in a direction indicated by arrow 228. The spin motion is created around an axis parallel to travel direction of shell through the air.

Figure 3:
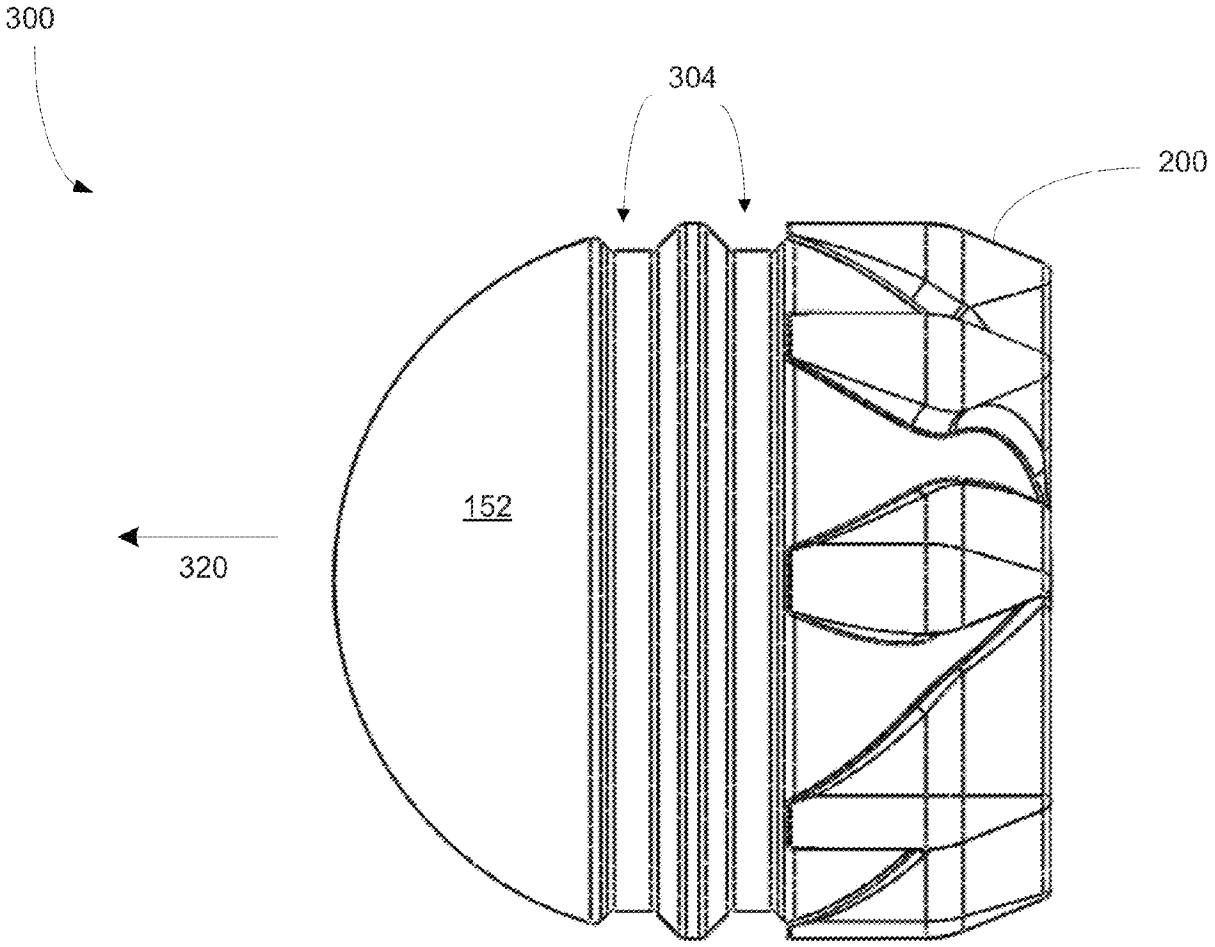
FIG. 3 is a diagram illustrating a delivery shell having a groove configured for a driving band in accordance with embodiments of the present invention.

FIG. 3 is a diagram illustrating a delivery shell 300 having a groove or grooves configured to house a driving band(s) in accordance with embodiments of the present invention. Shell 300 includes capsule 152 which is illustrated in FIG. 1B and disc 200 which is illustrated in FIG. 2A. Capsule 152 is coupled with disc 200 to form a delivery shell wherein disc 200, in one example, uses a set of blades to provide gyroscopic stability to improve accuracy of hitting the target. Depending on the applications, one or two driving bands can be installed in grooves 304. It should be noted that the installed driving band(s) will be situated approximately perpendicular to the travel direction of shell 300 as indicated by arrow 320. A function of driving band is that it further provides gyroscopic stability to improve accuracy and range. Another function of driving band is that it prevents gas leakage to the barrel during the launch process. Note that capsule 152 and disc 200 can be fabricated on a single unit.

Figure 4A:
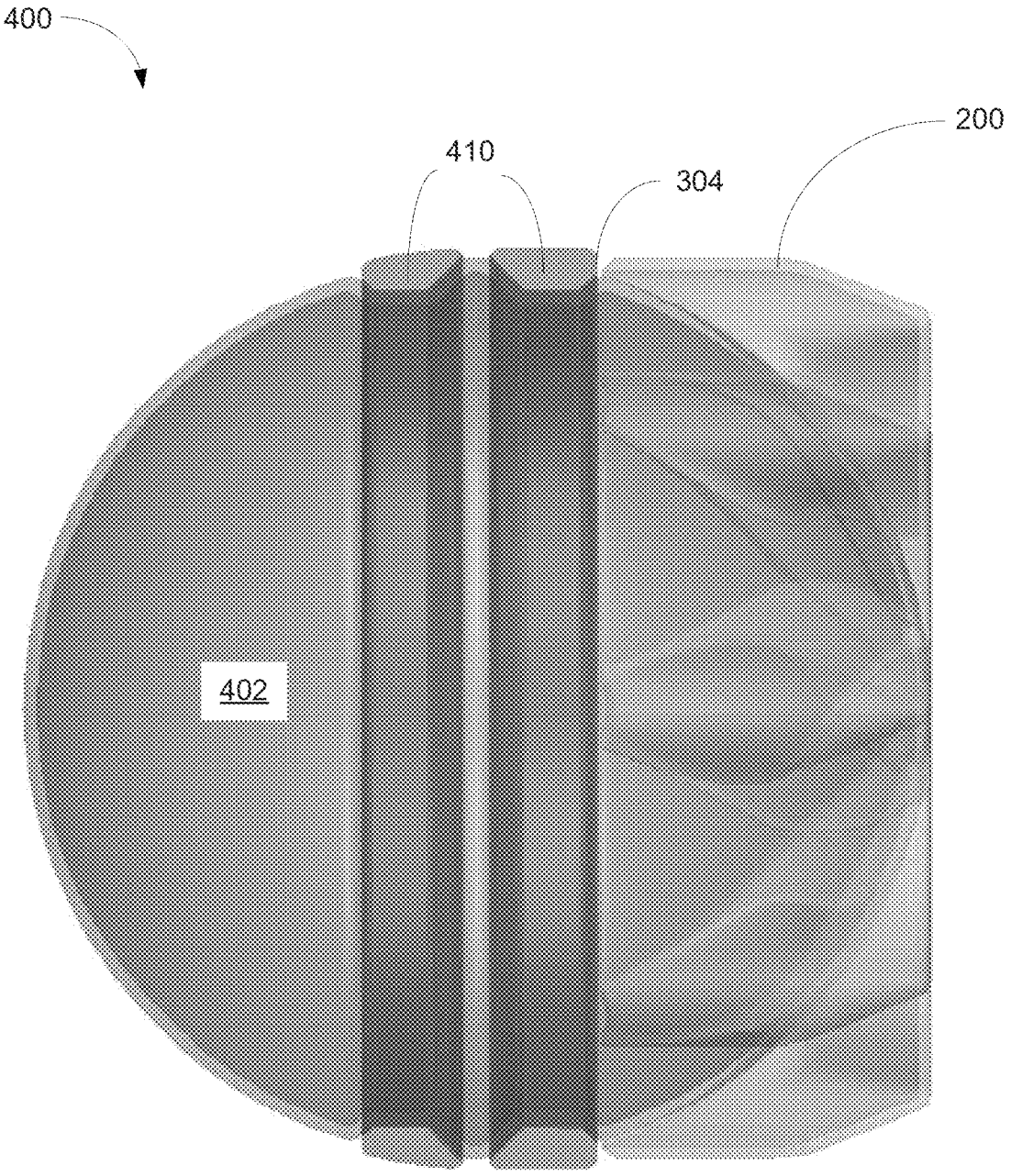
FIGS. 4A-D are diagrams illustrating a delivery shell having a driving band in accordance with one embodiment of the present invention.

FIGS. 4A-D are diagrams illustrating a delivery shell having a driving band(s) in accordance with one embodiment of the present invention. FIG. 4A illustrates a delivery shell 400 having capsule 402, disc 200, and two driving bands 410 capable of being launched by a paintball gun. Capsule 402, in one embodiment, has a round-shaped vessel capable of storing and delivering colored marker upon breakage of the vessel. In an alternative embodiment, Capsule 402 includes a dome-shaped head and a conical body configured to store and delivery colored marker upon breakage of the capsule.

Disc 200 having a propeller-shaped tail portion is coupled to capsule 402. The propeller-shaped tail portion includes a set of curved blades which have aerodynamic surfaces capable of forming air channels between the curved blades and surface of capsule 402. The air channels, in one example, guide airflows when the projectile is launched and travels through the air. Note that the set of curved blades facilitates or generates spin motion for the projectile or shell 400 whereby the accuracy of projectile to hit a target is enhanced.

Driving bands 410, in one embodiment, are manufactured in circular rings with relatively flexible materials. Driving bands 410 are configured to fit into the installing grooves 410. The outer diameter of driving band 410 is configured to approximately match the bore diameter of the barrel of the projectile launcher or paintball gun. A function of driving bands 340 is to provide a seal effect between shell 400 and the wall of barrel to prevent or reduce gas leakage to the barrel during the launch. Single band may be used. In one embodiment, driving band 410 may be opening rings.

A spinning track, in one aspect, is imprinted on the wall of barrel for creating a spinning motion of shell inside of barrel as the shell moves from the firing chamber to the opening of barrel. The spinning track receives a portion of driving band 410 and uses driving band 410 to spin shell 400 as shell 400 travels through the barrel. An advantage of using a driving band is that it improves compression ability and launch efficiency with gas-powered guns. Another advantage of using a driving band is to provide gyroscopic stability to enhance accuracy and range. In one embodiment, the driving band is made of biodegradable materials, such as expanded corn foams, wheat, sugar, wood, or the like.

Figure 4B:
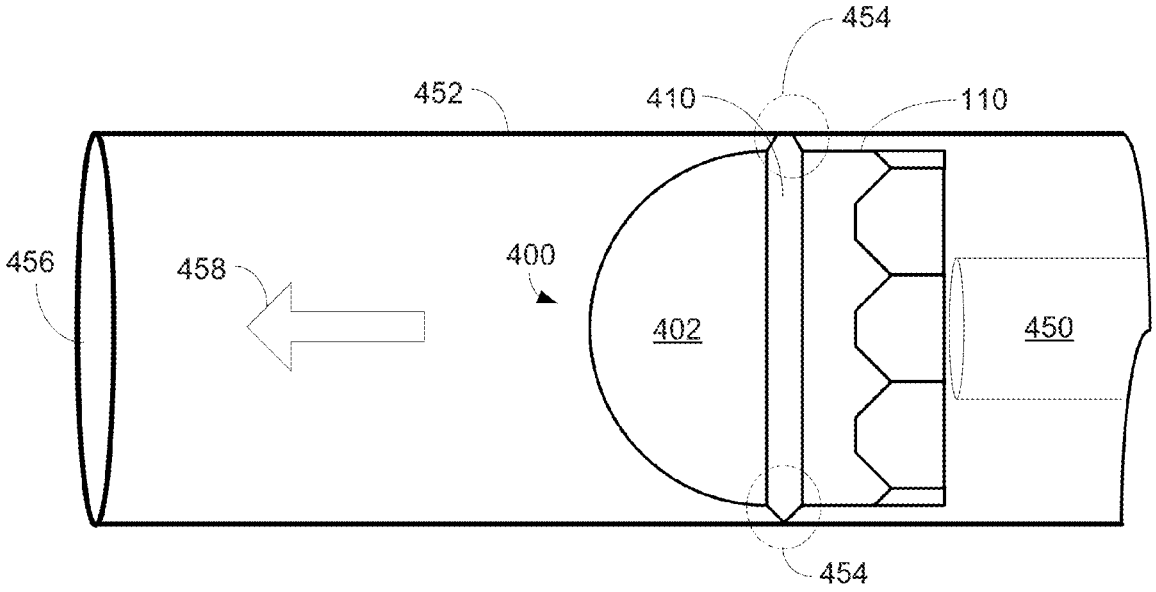

FIG. 4B is a diagram illustrating a paintball gun including a barrel 452, a delivery shell 400, and a gas-powered propeller 450 capable of using a driving band 410 in accordance with one embodiment of the present invention. Shell 400 is loaded to a firing or launch chamber wherein the top or outer portion of driving band 410 touches the inner wall 454 of barrel 452 to reduce or minimize gas leakage from propeller 450 into barrel 452 during the launch. During operation, when propeller 450 releases gas or CO2, shell 400 moves from the launch chamber toward the opening of barrel 456 in a direction indicated by numeral 458. It should be noted that the driving band 410 improves the efficiency of gas-powered launch whereby driving band increases range of shell 400.

Figure 4C:
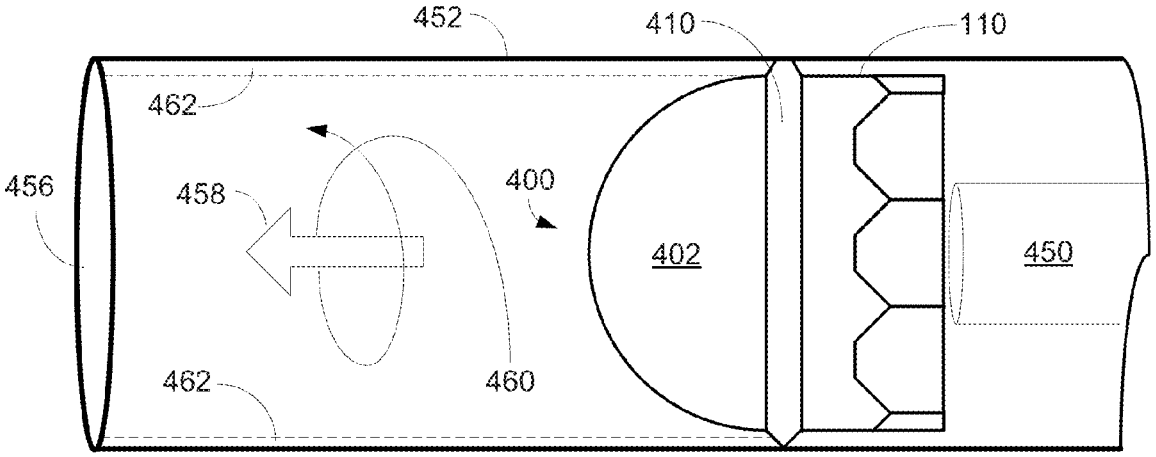

FIG. 4C is diagram illustrating a paintball gun including a barrel 452, a delivery shell 400, and a gas-powered propeller 450 capable of using a driving band 410 for spinning in accordance with one embodiment of the present invention. In one embodiment, barrel 452 includes a spiral track or spinning track 462 wherein spiral track 462 is able to house driving band 410. When propeller 450 releases gas or CO2, shell 400 moves from the launch chamber toward the opening of barrel 456 in a direction indicated by numeral 458. Since driving band 410 is fitted with spiral track 462, track 462 causes shell to spin inside of barrel 452 with a direction indicated by numeral 460. It should be noted that the driving band 410 causes shell 400 to spin before it leaves barrel 452 to create a gyroscopic stability for accuracy enhancement.

Figure 4D:
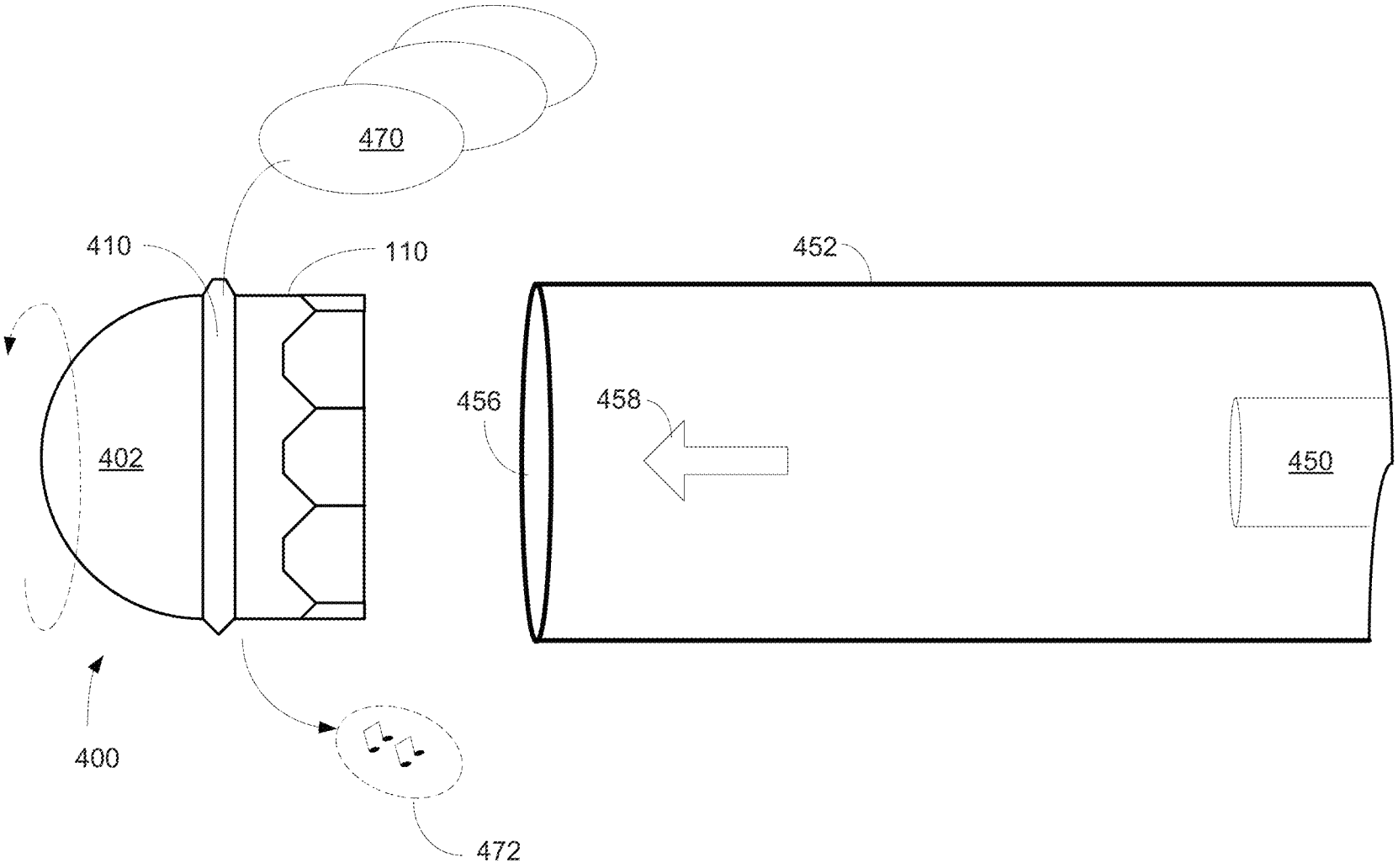

FIG. 4D is a diagram illustrating a paintball gun including a barrel 452, a delivery shell 400, and a gas-powered propeller 450 capable of using a driving band 410 in accordance with one embodiment of the present invention. Once shell 400 leaves barrel 452, driving band 410, in one embodiment, begins to create a fire or combustion 470 having a burning effect. Driving band 410 not only provides a gyroscopic stability, but also provides a fire ball. Generating a fire ball effect can be helpful to create special effects for movie shootings. Other applications are possible. For example, fire delivery by shell 400 may be useful to provide fire control during a wildfire. Alternatively, driving band 410 can also deliver a sound effect such as whistling or playing music 472 as shell 400 flying or traveling through the air. It should be noted that depending on the applications, any number of driving bands may be used.

Figure 5B:
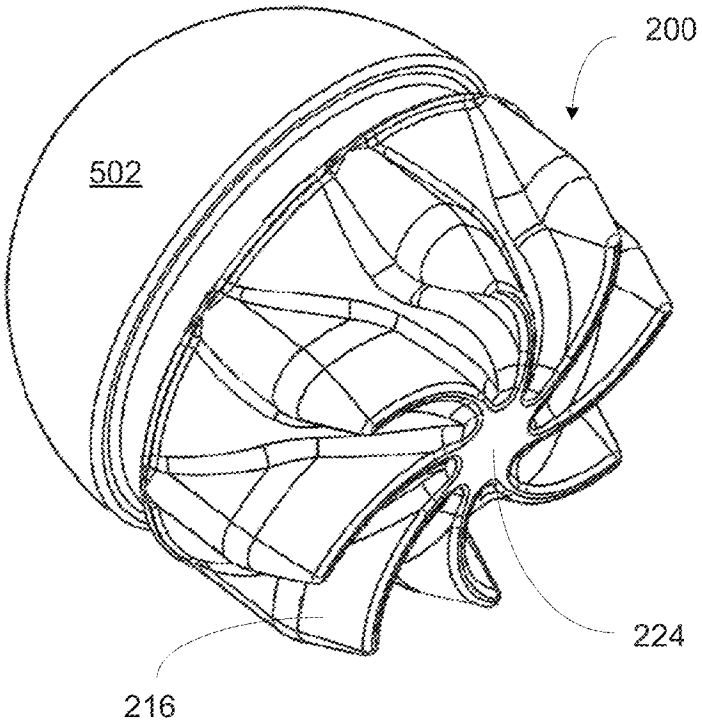
FIGS. 5A-D are diagrams illustrating a delivery shell having a capsule with a dome-shaped head and cone-shaped body in accordance with one embodiment of the present invention.
Figure 5A:
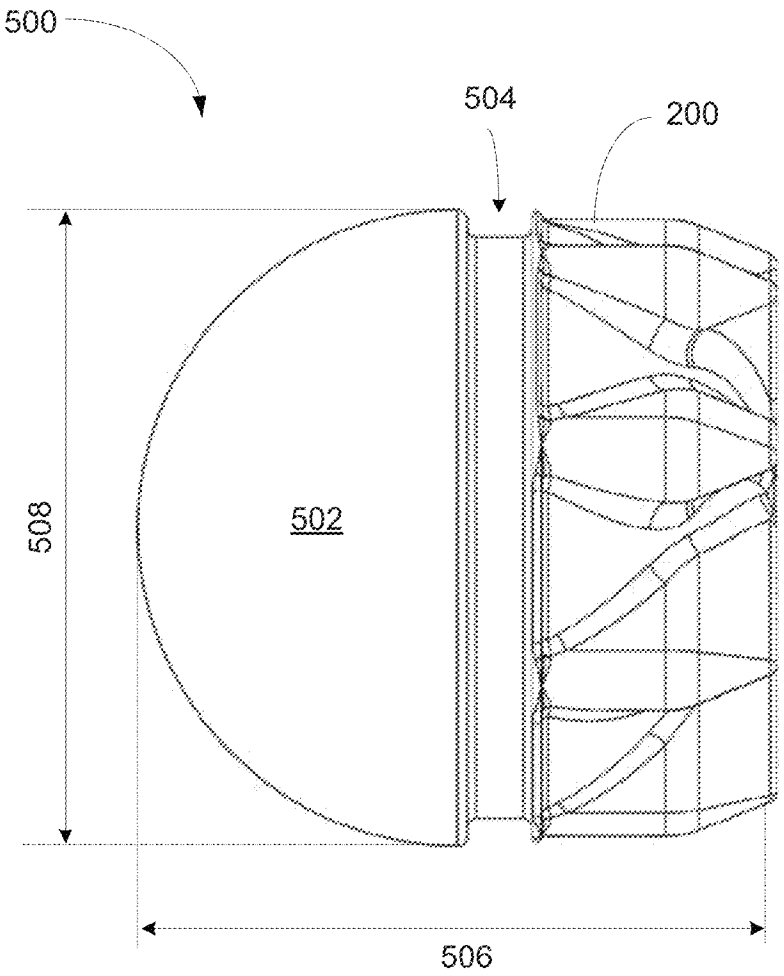

FIGS. 5A-D are diagrams illustrating a delivery shell having a capsule with a dome-shaped head and cone-shaped body in accordance with one embodiment of the present invention. FIG. 5A illustrates a delivery shell 500 having capsule 502 and disc 200 capable of being launched by a paintball gun. FIG. 5B illustrates shell 500 having a back angle view showing disc 200. Capsule 502, in one embodiment, has a round-shaped vessel capable of storing and delivering colored marker upon breakage of the vessel. In an alternative embodiment, Capsule 502 includes a dome-shaped head and a conical body configured to store and delivery colored marker upon breakage of the capsule. In one embodiment, shell 500 has a groove 504 capable of housing a driving band.

Disc 200 having a propeller-shaped tail portion is coupled to capsule 502. The propeller-shaped tail portion includes a set of curved blades which have aerodynamic surfaces capable of forming air channels between the curved blades and surface of capsule 502. The air channels, in one example, guide the airflows when the projectile is launched and travels through the air. Note that the set of curved blades facilitates a spinning motion for the projectile or shell 500 to enhance the accuracy of the projectile to hit a target.

Depending on the applications, various size or dimension of shell 500 may be fabricated. For example, to make shell 500 compatible with various types of existing launcher equipments, shell 500 may be configured to have height 506 of disc to be approximately the same as diameter 508 of capsule 502.

Figure 5C:
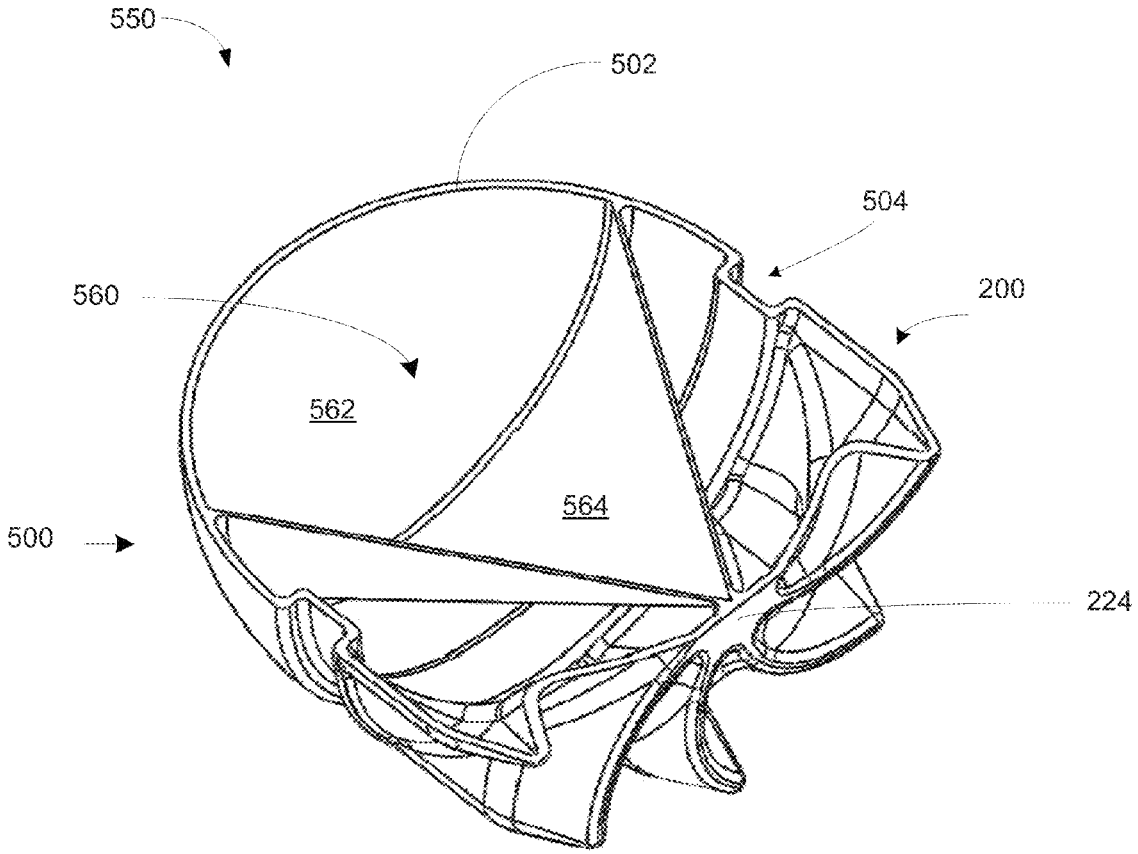

FIG. 5C is a 3D cross-sectional diagram 550 illustrating an exemplary internal structure of shell 500 having a dome-shaped head and a conical or cone-shaped body. For example, diagram 550 shows shell 500 containing a cavity 560 wherein cavity 560 is enclosed by a spherical dome-shaped base 562 and a conical body 564. The vertex of conical body 564, for instance, is coupled to base 224 of disc 200. Cavity 560 is capable of carrying lethal payload such as explosives or chemical/biological agents. Alternatively, cavity 560 is able to carry non-lethal content such as marking dye and/or paint. The vertex of the conical body 564, in one example, maybe truncated and can be opened through base 224 to provide access to cavity 560.

Figure 5D:
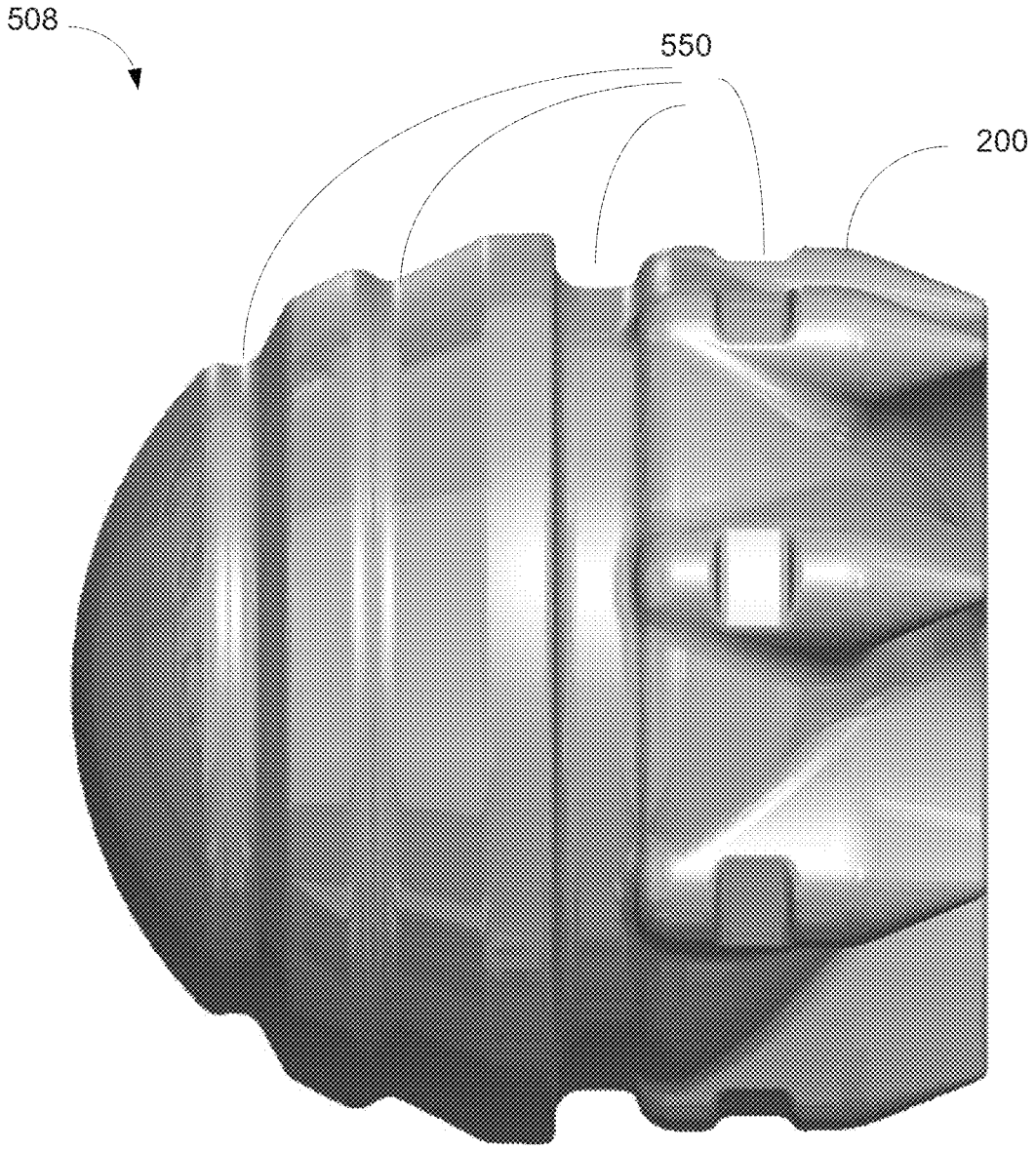

FIG. 5D is a 3D diagram illustrating an alternative embodiment of shell 508 having a dome-shaped head and a conical or cone-shaped body. Shell 508 includes multiple grooves 550 capable of housing up to four driving bands. It should be noted that one driving band can installed at disc 200.

Figure 6B:
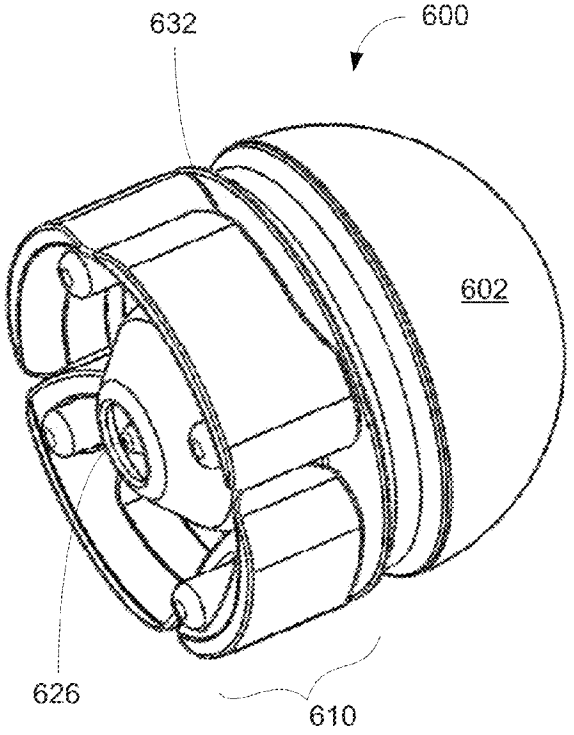
FIGS. 6-7 are diagrams illustrating a delivery shell having movable fins in accordance with one embodiment of the present invention.
Figure 6A:
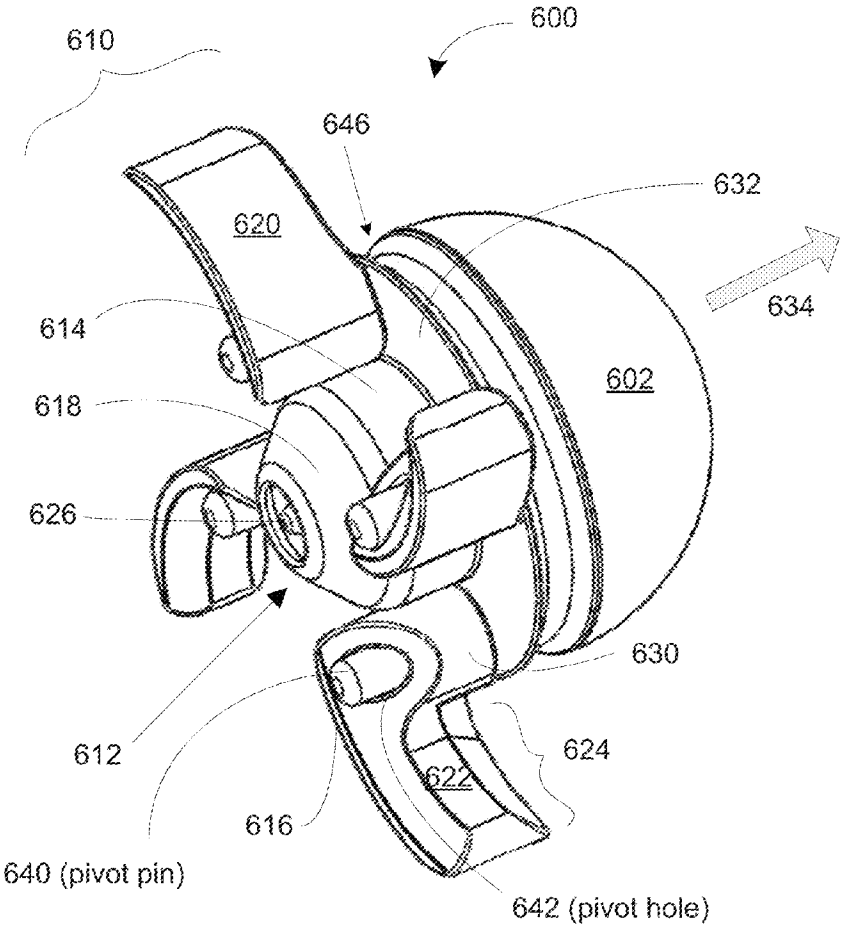
Figure 6C:
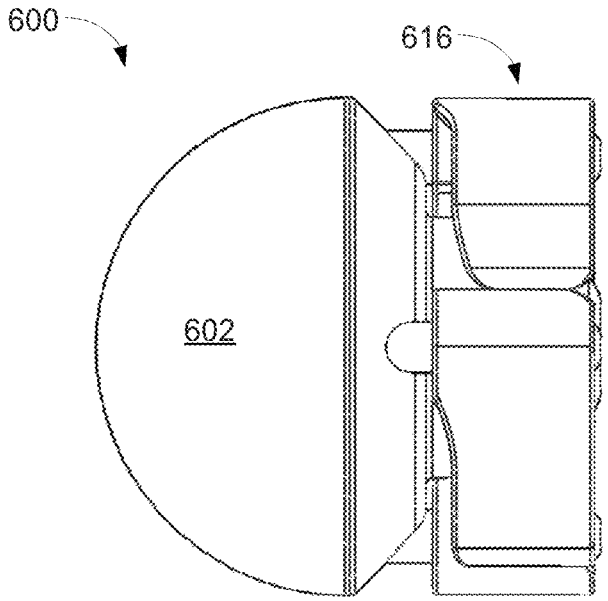
Figure 6D:
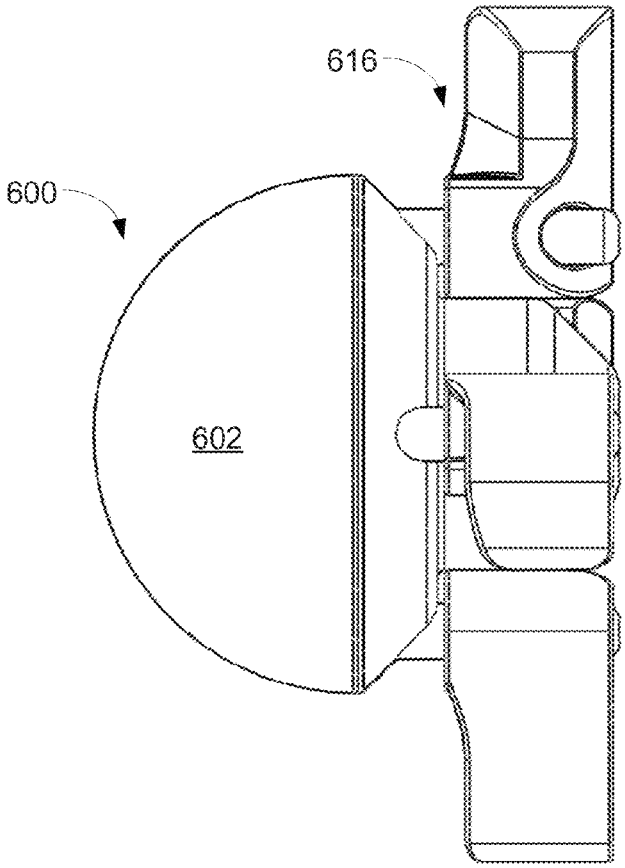
Figure 6E:
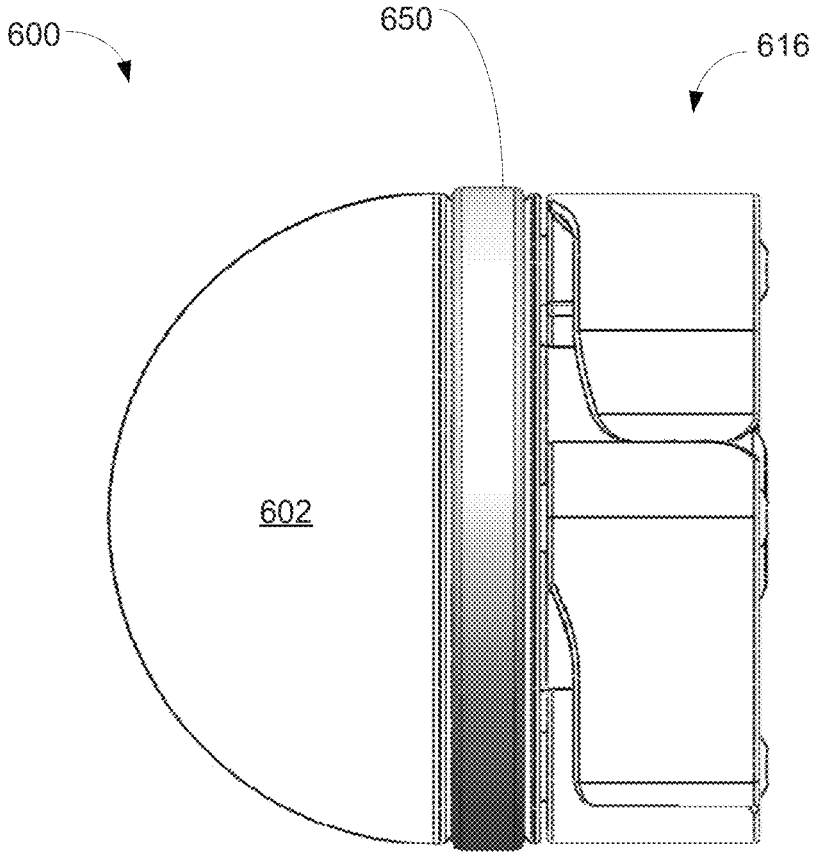
Figure 6F:
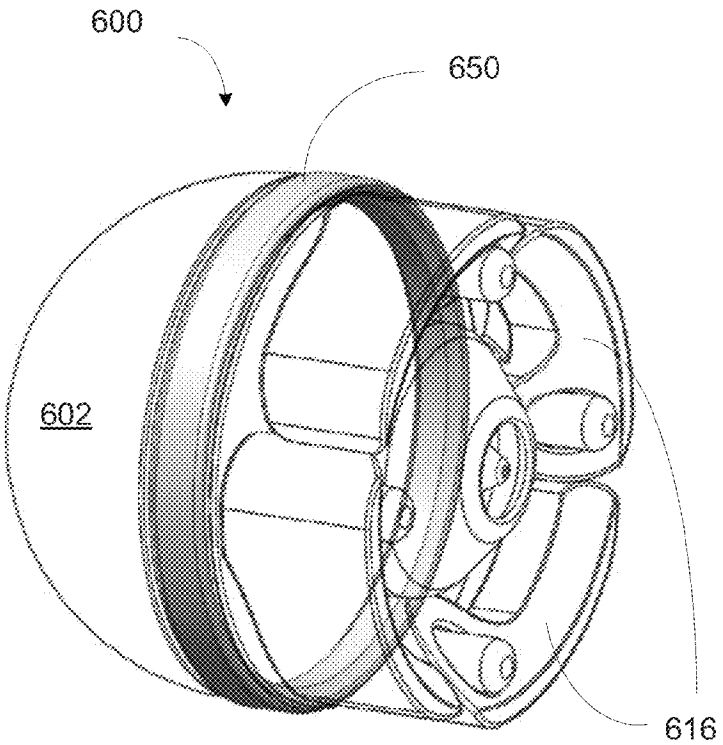
Figure 6G:
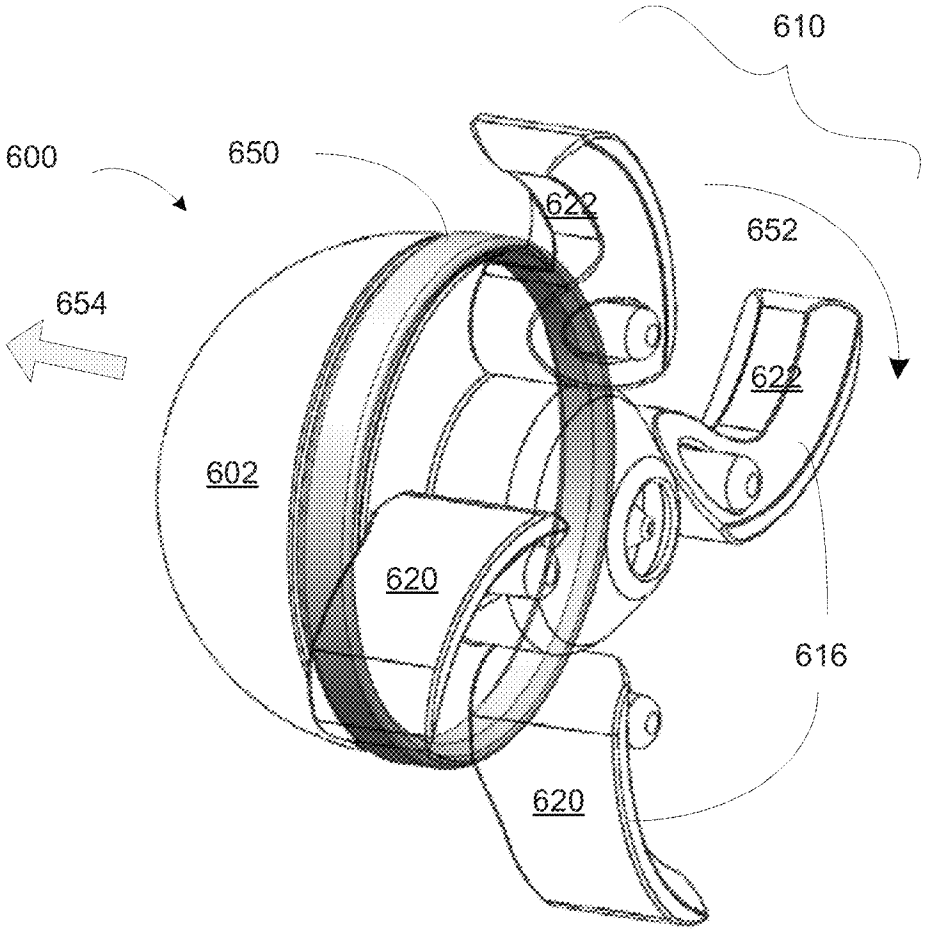
Figure 6H:
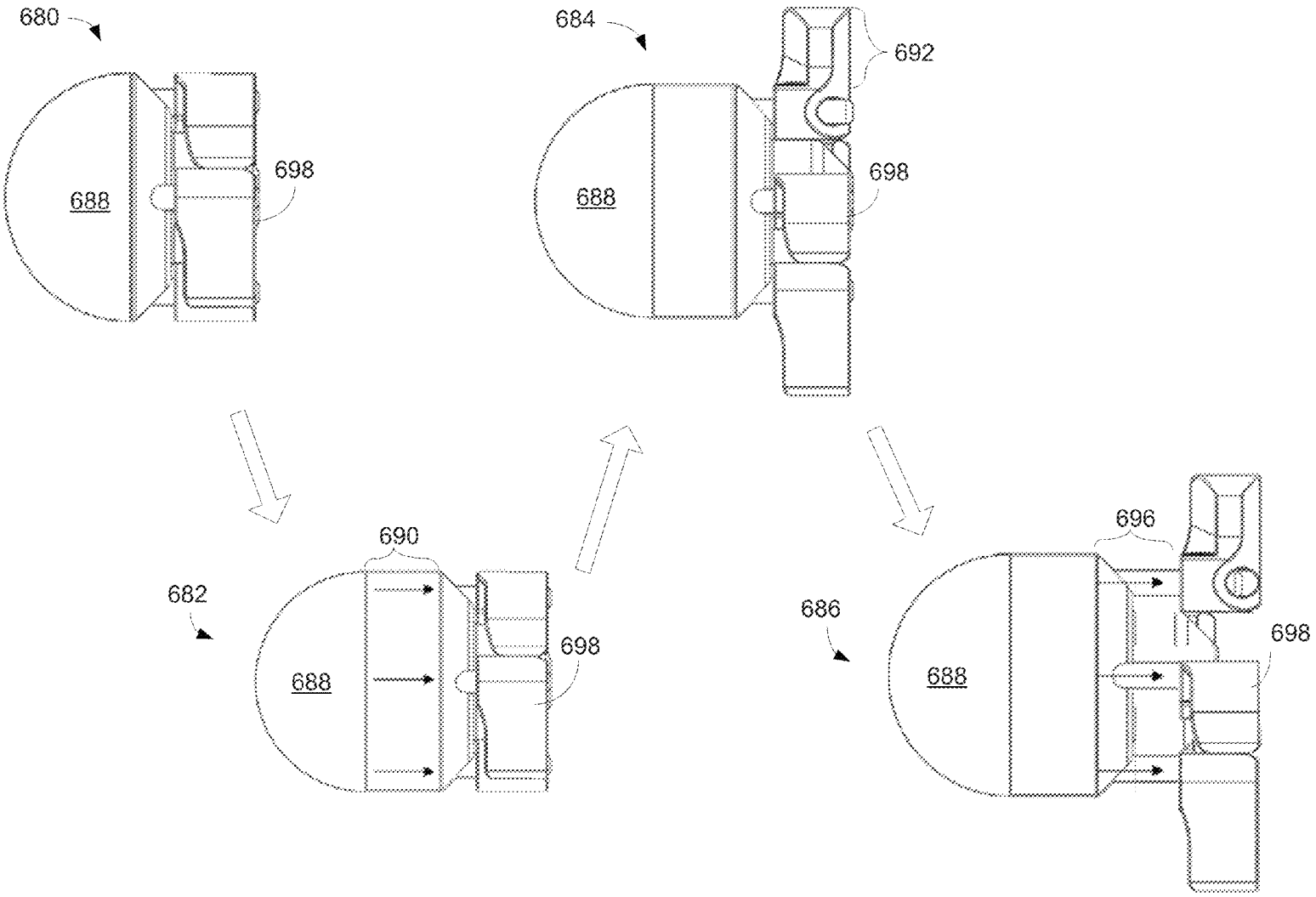
Figure 7:
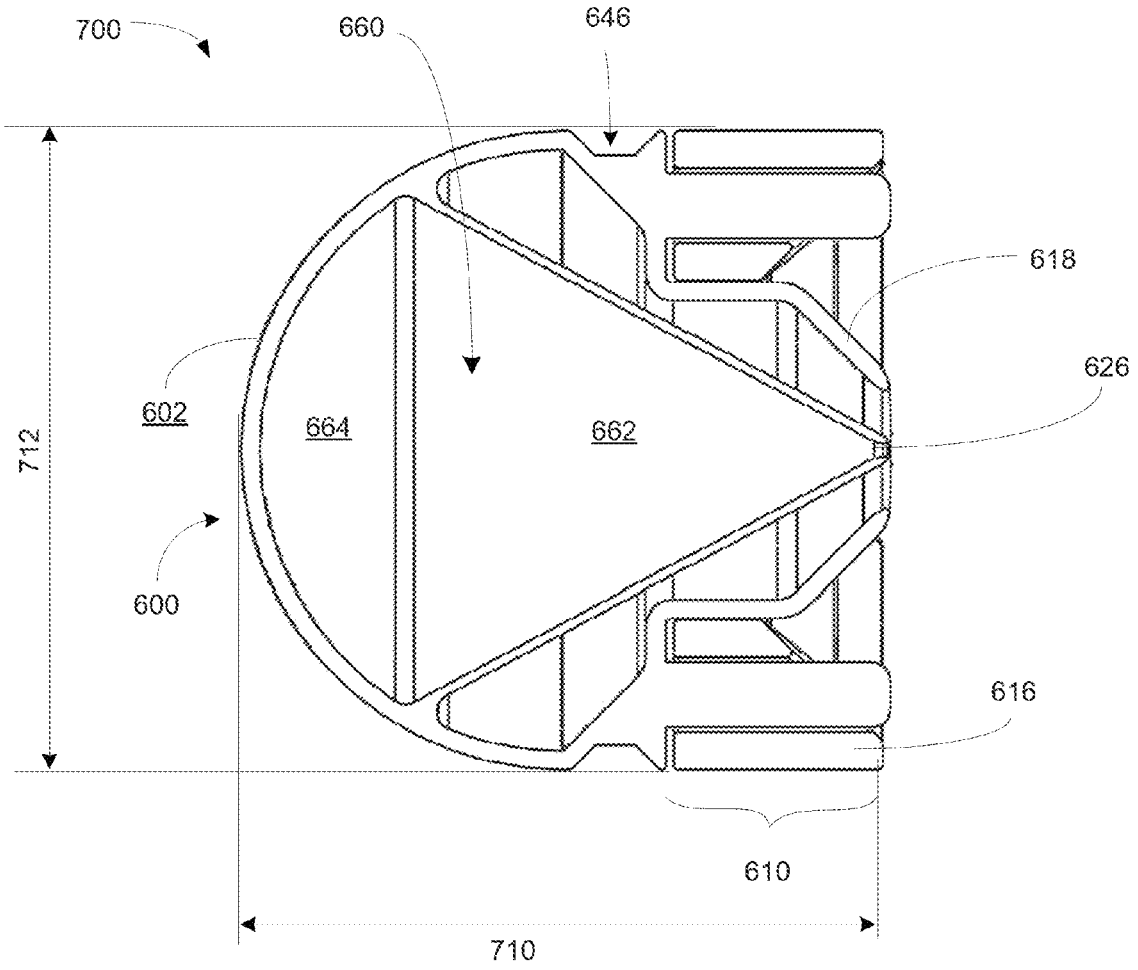

FIGS. 6-7 are diagrams illustrating a delivery shell having movable fins in accordance with one embodiment of the present invention. FIG. 6A illustrates a shell 600 having four foldable blades or movable fins 616 wherein shell 600 is in an operation position. The operation position means all movable fins are fully extended for catching pass-by airflow to make shell 600 to spin when it is launched in the air. FIG. 6B illustrates shell 600 which is in a folding position before it is being launched. When movable fins 616 are in a closed position or folding position, fins 616, in one aspect, are contained inside an outer perimeter of annular base 632. FIG. 6C is a side view of shell 600 in folding position. FIG. 6D is a side view of shell 600 in operation position.

Shell 600, in one embodiment, includes a capsule 602, an annular base 632, pivot pins 640, and movable fins 616. Capsule 602 having a round head and a conical body is capable of storing and delivery payload such as colored marker upon breakage of capsule 602. Annular base 632 has an opening which is configured to allow a portion of capsule 602 to pass through such as a portion of the conical body. Pivot pins 640 are configured to anchor to annular base 632, and movable fins 616 are coupled to pivot pins 640. In one example, movable fins form a foldable curved propeller having four twisted blades able to form a substantially circular column around a cylindrical body 618 of annular base 632 before shell 600 is launched into air stream.

Movable fins 616, in one embodiment, are used to enhance accuracy and/or travelling distance of shell 600. Movable fins 616 can be configured as four twisted blades, wherein each blade has a helical surface 620-622 capable of generating a force in response to airflow that passes through the helical surface. When shell 600 is launched into the air stream, movable fins pivot open in operation position or mode capable of facilitating to cause or assist a spinning motion for shell 600. In one example, movable fins 616 are able to extend beyond the circumferential boundary of annular base 632 when they are in operation position. Alternatively, when movable fins 616 are in folding position, movable fins 616 are contained within a circumferential boundary of annular base 632.

Referring back to FIG. 6A, shell or projectile 600 includes a dome-shaped capsule 602, a circumferential groove 646 adjacent to capsule 602 and a tail portion 610. Tail portion 610 is attached to annular base 632 next to circumferential groove 646. Dome-shaped capsule 602 may be used to carry lethal content such as explosives. Alternatively, capsule 602 is configured to carry non-lethal content such as marking dyes. Tail portion 610 includes cylindrical body 612, movable fins 616, and pivot pins 640. The diameter of cylindrical body 612, in one example, is smaller than the diameter of dome-shaped capsule 602. Cylindrical body 612, in one example, is connected to a center region of annular base 632. Cylindrical body 612, in one aspect, includes a right circular cylinder 614 and an open-ended, truncated circular cone 618 which is attached to a side of cylinder 614 opposite to annular base 632. The open-ended, truncated circular cone 618 provides an access for entering internal space of dome-shaped capsule 602. An access port 626 may be constructed to serve as an entry to the internal of shell 600.

Movable fin 616 includes a fin body 624 having a top flow surface 620 and a lower flow surface 622, and a pivoting base 630 connected to fin body 624. Top flow surface 620 and lower flow surface 622 are aerodynamic surfaces. Pivoting base 630 contains a pivot hole 642 for engaging with a pivot pin 640. Pivot pins 640 are attached to annular base 632 and are situated at equal or the same distance from cylindrical body 612. Pivot pins 640 are also equally spaced circumferentially in annular base 632. Movable fins 616 are pivotally attached to pivot pins 640 through pivot holes 642 in pivoting base 630. Fin 616 is in operation position when fin body 624 pivots away from cylindrical body 612. Fin 616 is in folding position when fin body 624 pivots to toward cylindrical body 612.

Pivot hole 642 and pivot base 630 are shaped in such a way that when fins 616 pivot to a desired operation position, a locking between fins 616 and cylindrical body 612 is created to prevent any further opening movement of the aerodynamic fins 616. Pivot hole 642, in one example, is an oblong shaped hole which allows fin 616 to move in a circumferential direction of annular base 632 while swiveling around pivot pin 640. In one aspect, a spring such as a torsional spring may be used to open fins 616 between pivot pin 640 and pivoting base 630. The torsional spring is in a winded state when fins 616 are in folding position or in closed status.

FIGS. 6E-F are 3D diagrams showing a delivery shell 600 with a driving band 650 in accordance with one embodiment of the invention. Capsule 602 further includes a circular ring installed in a circular circumferential undercut groove between the hemispherical capsule and the annular base. FIGS. 6E and F illustrate shell 600 having a dome-shaped capsule 602, a tail portion, and movable fins 616 wherein fins 616 are in a folding position. FIG. 6G illustrates a shell 600 in the operation position with a driving band 650. When shells 600 are stored or loaded in a projectile launcher, fins 616 are in closed or folding position as shown in FIGS. 6E and F. Fins 616, in one example, remain in folding position until shell 600 is launched. When shell 600 leaves the barrel of a launcher, fins 616 swing open in operation position as shown in FIG. 6G. As shell 600 travels toward a target with a direction indicated by arrow 654, air flows over the surface of dome-shaped capsule 602 to tail portion 610 via driving band 650. The airflow generates a force via band 650 and movable fins 616 to cause shell 600 to spin.

FIG. 6H illustrates an alternative embodiment of a delivery shell having a capsule 688 and a disc 698 in accordance with one embodiment of the invention. Diagrams 680-686 illustrate an exemplary process of changing shell's physical configuration as it is being launched by a gas-powered launcher such as a paintball gun. Diagram 680 illustrates a shell in a folding position. When the shell is in folding position, it has a dimension that will fit for any standard loading magazines before launching. Diagram 682 illustrates the shell has been launched from the firing chamber. As the shell moves through the barrel, capsule 688 extends a portion of its body as indicated by numeral 690. As soon as the shell exits the barrel, a portion of movable fins swings open as indicated by numeral 692 as shown in diagram 684. After movable fins are in operation position, the movable fins move along pivot pin away from capsule 688 as indicated by numeral 696 in diagram 686. When capsule 688 is extended and movable fins are in their full operation mode, extended capsule 688 and disc 698 with movable fins optimize weight distribution of shell as well as structural balanced whereby shell's accuracy and distance can be improved.

FIG. 7 is a two-dimensional ("2D") cross-sectional diagram 700 illustrating an exemplary internal structure of delivery shell or projectile 600 in accordance with one embodiment of the invention. Diagram 700 shows shell 600 having a capsule 602 wherein capsule 602 contains a cavity 660. Cavity 660, in one embodiment, includes a dome-shaped base 664 and a conical shaped body 662. In one embodiment, cavity 660 is used to contain lethal agent such as explosive or chemical agents. Alternatively, cavity 660 carries non-lethal content such as marking dyes or paint. An access port 626 is located at the vertex of cone-shaped cavity 660. Port 626 is accessible via the opening of truncated cylindrical body 618. During fabrication, access port 626 may be used to load material such as marking dyes into cavity 660. In one example, the height 710 of shell 700 is equal or approximately equal to the diameter 712 of capsule 602.

FIGS. 8A-D are diagrams illustrating an alternative exemplary shell 800 having a capsule and a disc in accordance with one embodiment of the present invention. Shell 800, in one embodiment, includes a ball-shaped capsule 802 and a round-shaped disc 820. Shell 800 is capable of being launched by a paintball gun. Ball-shaped capsule 802 has a head 806 and a tail 808, and is hollow inside able to store and deliver colored markers upon an impact with an object. Round-shaped disc 820 is coupled to tail 808 of capsule 802 and is configured to position disc 820 to a location so that it allows a portion of round-shaped disc 820 to extend above outer surface of capsule 802. Disc 820 is able to catch at least a portion of airflow when shell 800 moves through the air. Disc 820 is able to utilize direction of the airflow to facilitate the travel direction of shell 800.

Disc 820 further includes a coupler 810 having a concave surface configured to receive tail 808 of capsule 802. A guiding ring 812 which can be part of disc 820 is coupled to coupler 810. Guiding ring 812, in one embodiment, has multiple openings 816 allowing air to pass through for guiding travel direction of the projection. Openings 816 of guiding ring 812 are configured to facilitate spinning motion of shell 800. The spinning motion, in one aspect, enhances travel distance and accuracy of projectile direction. The concave surface of coupler 810 contains a hole (not shown in figure) that allows a portion of tail 808 of ball-shaped capsule 802 to pass through.

Figure 8A:
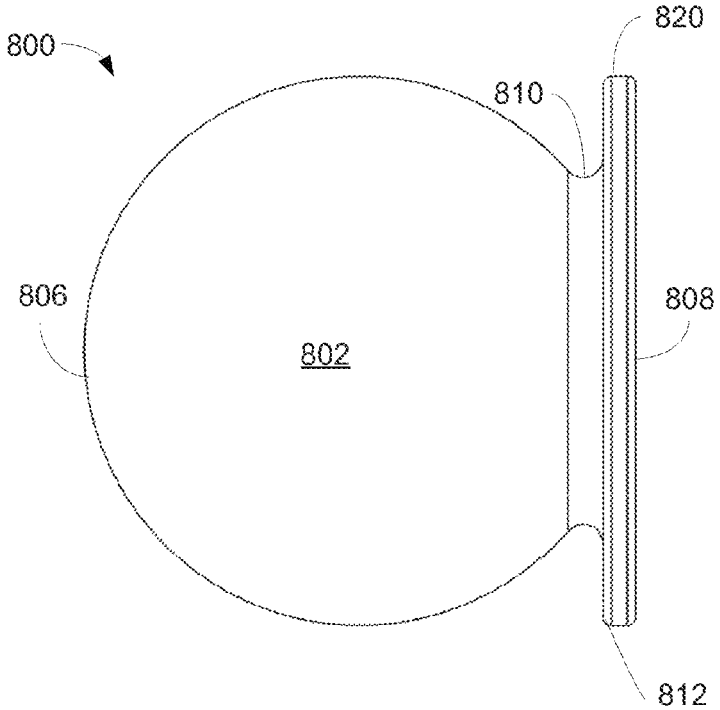
FIGS. 8A-D are diagrams illustrating an alternative exemplary shell having a capsule and a disc in accordance with one embodiment of the present invention.
Figure 8B:
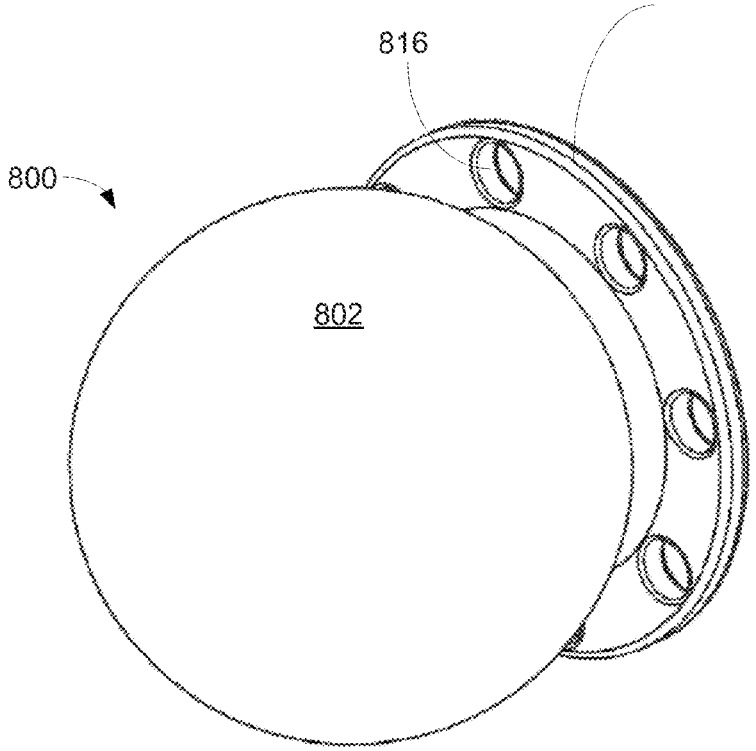
Figure 8C:
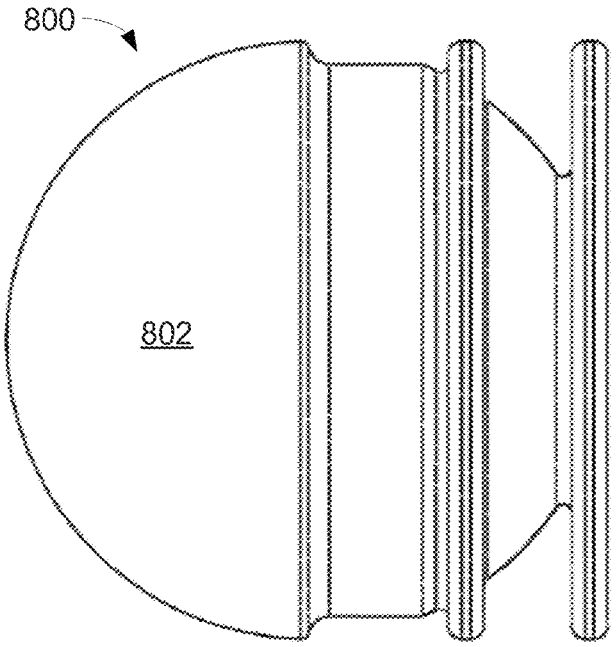
Figure 8D:
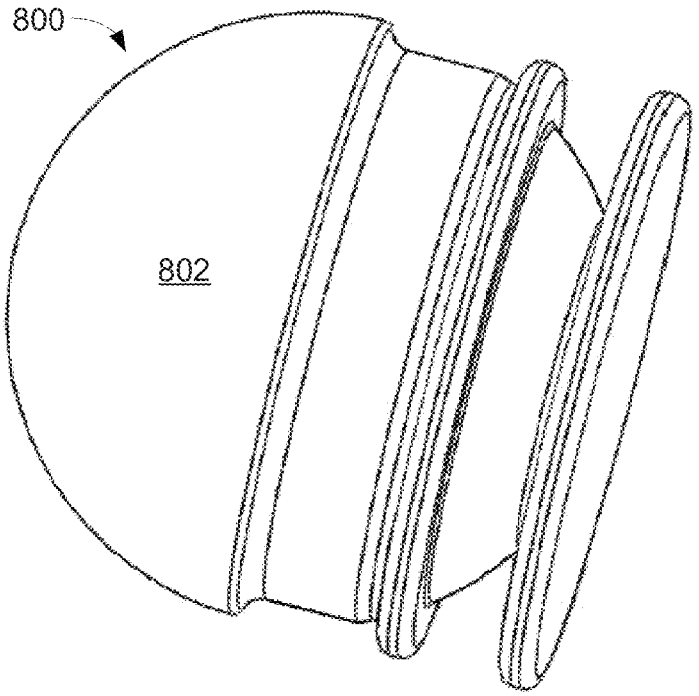

FIGS. 8C-D are diagrams illustrating an alternative exemplary shell 800 having a capsule capable of housing driving band(s), and a disc.

Figure 9:
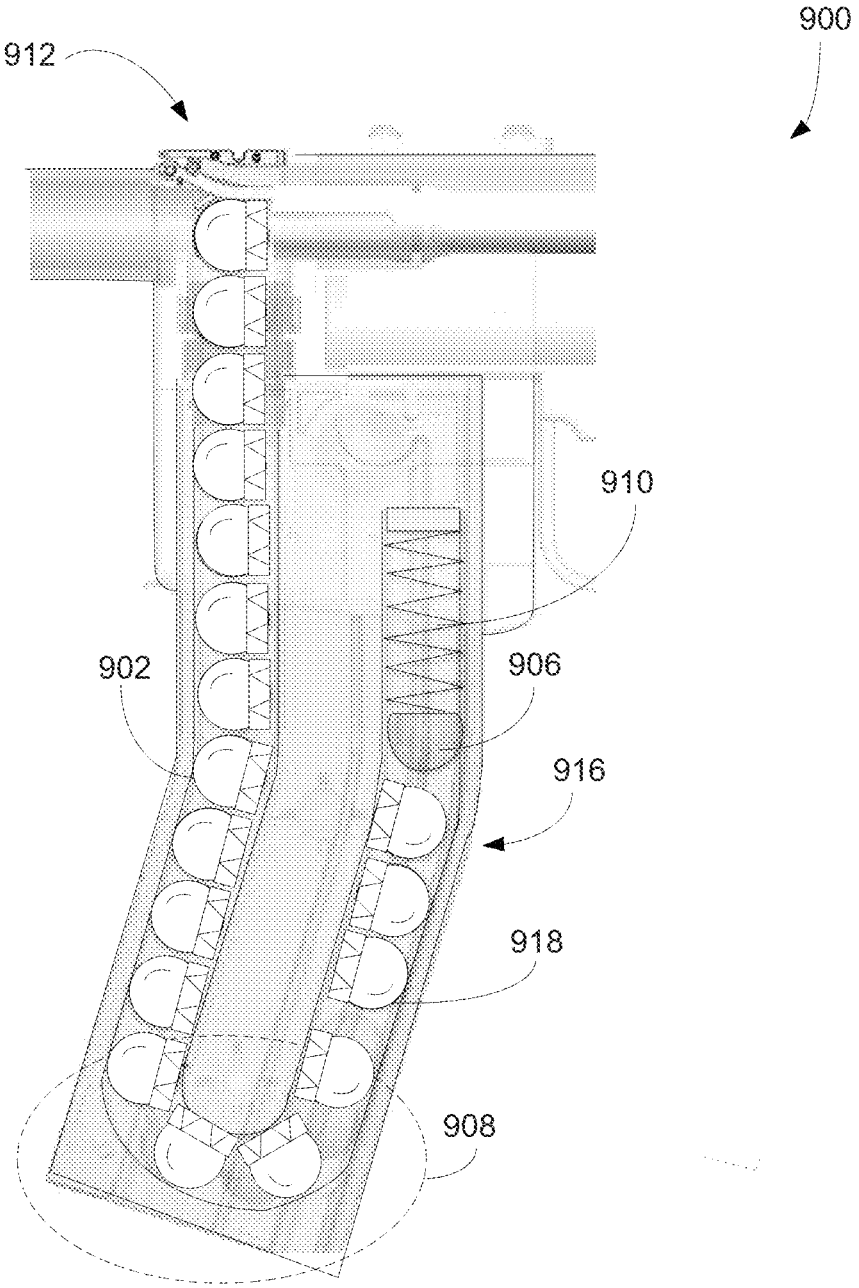
FIG. 9 is a diagram illustrating a gas-powered gun able to receive a magazine having multiple delivery shells in accordance with one embodiment of the present invention.

FIG. 9 is a diagram 900 illustrating a gas-powered gun able to receive a magazine having multiple delivery shells in accordance with one embodiment of the present invention. Diagram 900 includes a projectile or shell propelling system 912 and a magazine 916, wherein magazine 916 further includes a U-shaped storage channel 918, a follower 906, and a spring 910. The U-shaped storage channel 918 is able to house multiple projectiles or shells 902 wherein shells 902 are pushed or managed by follower 906 mounted at one end of spring 910. When magazine 916 is loaded with shells 902, all of shells, projectiles, or paintballs 902 travel through U-shaped storage channel 918 before they are being launched. It should be noted that dimension 908 of U-shaped storage channel 918 can and should change according to types of ammunition used. An advantage of using the magazine illustrated in diagram 900 is to maximize the usage of available space in the magazine.

Shells 902, in one embodiment, are similar to shell 100 shown in FIG. 1A, shells 300 shown in FIG. 3, shells 400 shown in FIG. 4A, shells 500 shown in FIG. 5A, shells 600 shown in FIG. 6A, or shell 800 shown in FIG. 8A. Alternatively, storage space in magazine 916 may include one straight storage column or two straight storage columns instead U-shaped storage channel 918. It should be noted that delivery shells capable of delivery payload are configured with certain dimensions whereby they can be launched by existing launch equipments such as gas-powered paintball guns.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A projectile capable of being launched by a paintball gun, comprising:

a substantial ball-shaped capsule having a head and a tail, and able to store and deliver colored marker upon an impact with an object; and a round-shaped disc coupled to the tail of the capsule and configured to position the round-shaped disc so that allowing a portion of the round-shaped disc to extend above outer surface of the capsule to catch at least a portion of airflow that flows from the head of the capsule when the projectile is moving, wherein the round-shaped disc is able to utilize direction of the airflow to facilitate travel direction of the projectile, wherein the round-shaped disc is configured to include a plurality of blades, wherein each of the plurality of blades has a blade tip edge, a blade body, and a blade exit edge, wherein the blade tip edge, the blade body, the blade exit edge, and a portion of capsule surface form an air channel for facilitating spinning motion of the projectile, wherein the exit edges of the plurality of blades have curved shapes, wherein portions of the exit edges are commonly joined at a flat base plane.

2. The projectile of claim 1, wherein the round-shaped disc includes:

a coupler having a concave surface configured to receive the tail of the capsule.

3. The projectile of claim 2, wherein the round-shaped disc is configured to facilitate spinning motion of the projectile to enhance travel distance and accuracy of projectile direction.

4. The projectile of claim 3, wherein the spinning motion of the round-shaped disc provides a gyroscopic stability to improve accuracy and distance of the projectile.

5. The projectile of claim 2, wherein the concave surface of the coupler contains a hole allowing a portion of the tail of ball-shaped capsule to pass through.

6. The projectile of claim 1, wherein the round-shaped disc further includes a plurality of angular shaped protruding fins configured to catch airflow.

7. The projectile of claim 6, wherein the plurality of angular shaped protruding fins facilitates a spinning motion of the round-shaped disc when airflow flows between the plurality of angular shaped protruding fins.

8. A paintball comprising:

a capsule having an ellipsoid shaped body capable of storing and delivery colored marker upon breakage of the capsule;

an annular base having an opening which is configured to allow a portion of the capsule to pass through so that allowing a portion of the annular base to extend above outer surface of the capsule to catch airflow which flows from the capsule to the portion of the annular base when the paintball travels through air, wherein the annular base directs the airflow to provide guidance of paintball travel direction, wherein the annular base includes blades, wherein each of the blades has a blade tip edge, a blade body, and a blade exit edge, wherein the blade tip edges, the blade bodies, the blade exit edges, and a portion of capsule surface facilitate spinning motion of the paintball, wherein the exit edges have curved shapes and are commonly joined at a base.

9. The projectile of claim 8, wherein the annular base includes a coupler having a concave surface configured to receive a portion of the capsule.

10. The projectile of claim 9, wherein the annular base generates a plurality of airflows for guiding travel direction of the projection.

11. The projectile of claim 9, wherein the concave surface of the coupler contains a hole allowing a portion of the tail of ball-shaped capsule to pass through.

12. The projectile of claim 8, wherein the annular base is configured to facilitate a spinning motion of the projectile to enhance travel distance and accuracy of projectile direction.

13. The projectile of claim 8, wherein the annular base includes a plurality of curved blades, wherein the plurality of curved blades includes aerodynamic surfaces capable of forming air channels between the plurality of curved blades and surface of the capsule.

14. A projectile capable of being launched by a paintball gun, comprising:

a substantial ball-shaped capsule having a head and a tail, and able to store and deliver colored marker upon an impact with an object; and a round-shaped disc coupled to the tail of the capsule and configured to position the round-shaped disc so that allowing a portion of the round-shaped disc to extend above outer surface of the capsule to catch at least a portion of airflow when the projectile is moving, wherein the round-shaped disc includes a plurality of blades, wherein each of the plurality of blades has a blade tip edge, a blade body, and a blade exit edge wherein the blade body is wider than the blade tip edge which is able to guide direction of the airflow from the head of the capsule, wherein the exit edges of the plurality of blades are configured to have curved shapes, wherein the round-shaped disc is configured to facilitate a spinning motion of the projectile to enhance travel distance and accuracy of projectile direction.

* * * * *